US006656092B1

(12) United States Patent
Fulks

(10) Patent No.: US 6,656,092 B1
(45) **Date of Patent: *Dec. 2, 2003**

(54) METHOD AND APPARATUS FOR EXERCISE WITH FORCED PRONATION OR SUPINATION

(76) Inventor: Kent Fulks, 9710 Amberly Dr., Dallas, TX (US) 75243

( * ) Notice: Subject to any disclaimer, the term of this patent is extended or adjusted under 35 U.S.C. 154(b) by 405 days.

This patent is subject to a terminal disclaimer.

(21) Appl. No.: 09/095,360

(22) Filed: Jun. 10, 1998

Related U.S. Application Data

(63) Continuation-in-part of application No. 08/667,428, filed on Jun. 21, 1996, now Pat. No. 5,769,757.

(51) Int. Cl.[7] ..... A63B 23/12; A63B 21/08

(52) U.S. Cl. ..... 482/45; 482/97; 482/136; 482/139

(58) Field of Search ..... 482/45, 46, 97, 482/139, 134–137; 601/44, 40

(56) References Cited

U.S. PATENT DOCUMENTS 4,411,424 A * 10/1983 Barnett ..... 482/99
5,254,066 A * 10/1993 Brown et al. ..... 482/137
5,336,148 A * 8/1994 Ish, III ..... 482/98
5,342,270 A * 8/1994 Jones ..... 482/98
5,413,546 A * 5/1995 Basile ..... 482/137
5,486,150 A * 1/1996 Randolph ..... 482/133
5,562,577 A * 10/1996 Nichols et al. ..... 482/97
5,769,757 A * 6/1998 Fulks ..... 482/45
5,810,701 A * 9/1998 Ellis et al. ..... 482/136

FOREIGN PATENT DOCUMENTS

FR 690722 * 9/1930 ..... 482/148

* cited by examiner

*Primary Examiner*—Nicholas D. Lucchesi
*Assistant Examiner*—Victor K. Hwang
(74) *Attorney, Agent, or Firm*—John F. Bryan

(57) ABSTRACT

An exercise device includes forced pronation or supination movement of the hands and arms in conjunction with the standard range of motion for a specified exercise. The device comprises a conventional frame and a centrally mounted seat. Pivotally attached to the frame is a sub-frame including a pair of levers that pivot in tandem about a first horizontal axis of rotation A1 and movably attached to the distal end of each lever is a double "L" shaped handle that includes a grip that pivots about a second axis of rotation A2. A2 is substantially perpendicular to A1 and the second leg of the double "L" shaped handle is movably attached with a ball and socket connection to a first end of a linkage rod. The second end of the linkage rod is movably attached with a second ball and socket connection to the frame.

9 Claims, 6 Drawing Sheets

280
282
263
262
A9
267
285
286
288
289
290
292
268
284
252
A8
256
258
259

METHOD AND APPARATUS FOR EXERCISE WITH FORCED PRONATION OR SUPINATION

This is a continuation-in-part of application Ser. No. 08,667,428 filed on Jun. 21, 1996 and issued as U.S. Pat. No. 5,769,757.

TECHNICAL FIELD

This invention relates generally to exercise machines and more particularly to exercise machines with forced pronation or supination movement for the hands and arms.

BACKGROUND OF THE INVENTION

Many athletes and non-athletes utilize weight lifting or weight training exercises to build strength and/or bulk, to prevent injury, or to improve overall condition and appearance. Typically, weight training exercises are performed with either exercise machines or free weights, i.e, barbells and weighted plates, dumbbells, etc. For various reasons, most exercise programs incorporate both machines and free weights in a variety of different exercise routines in order to maximize the effect of working the desired muscle groups.

Free weights offer a number of advantages over exercise machines. For instance, they are relatively inexpensive in comparison to exercise machines. Free weights are also more versatile because a variety of exercises can be performed with one set of weights, whereas most exercise machines are designed for only one exercise. Even though some exercise machines accommodate more than one exercise, the cost of these machines usually increases proportionately with the number of exercises. Use of dumbbells also enables both arms to be exercised independently. Finally, free weights are popular among many weight lifters because the lifting movements are not restricted to prescribed planes of motion or prescribed angles.

Nevertheless, there are also a number of inherent disadvantages associated with free weights. One such disadvantage relates to safety. Although most weight room instructors strongly advise against an individual working out alone, this cautionary measure is particularly important when the lifting of free weights is involved. This is due to commonly recognized dangers such as the possibility of dropping a weight on a body part, or becoming trapped beneath a bar, which could easily occur in exercises such as bench press, incline or squat. Additionally, through carelessness, loading and unloading of heavy weighted plates onto the ends of a bar sometimes results in an unbalanced bar that falls downward from its rack.

Another disadvantage associated with free weights relates to the fact that the weight resistance, or opposing force, that is exercised against is always directed vertically downward by gravity. Yet, the moment arm of the weight about the pivot point varies considerably throughout the full range of motion. This principle is explained in U.S. Pat. No. 3,998, 454 with respect to a commonly performed exercise referred to as the dumbbell bicep curl. In short, during this exercise the applied moment arm about tie elbow varies according to the sine of the angle of the lower arm with respect to the vertically oriented upper arm. The moment arm is greatest when the angle is 90° and it is lowest when the angle is 180° and 0°.

If the resistance capabilities of the muscles of the human body matched this moment arm, the degree of difficulty experienced by the exerciser would be uniform, or balanced, throughout the entire range of motion. However, as reported in U.S. Pat. No. 3,998,454, the strength generated by the human muscles during this exercise is not in fact "balanced" throughout the range of motion, and there are some "sticking points" of increased difficulty. As a result, maximum benefits are not achieved when performing a bicep curl with a dumbbell.

The pullover machine disclosed in U.S. Pat. No. 3,998, 454 utilizes an eccentric cam to vary weight resistance over the range of motion for the muscles utilized in a pullover maneuver. Over the years, for various muscle groups, a number of these cam and chain machines have been designed in an attempt to match a resistance variation through a range of motion with the natural strength curve for a particular muscle group associated with the range of motion. To the extent that these machines actually do succeed in approximating a resistance variation to an appropriate strength curve, an improvement over lifting of free weights probably has been achieved.

A number of exercise devices in the prior art allow the handles that the user grips to pivot freely while moving through. the desired range of motion for the prescribed exercise. However, a supination or pronation movement in the hands and forearms is desirable in conjunction with the standard range of motion for a specified exercise because additional muscle groups are exercised. Heretofore exercise devices have not typically included a forced pronation or supination movement of the hands and arms occurring as the hands and arms are moved through the desired exercise range of motion.

SUMMARY OF THE INVENTION

In accordance with the present invention, therein is disclosed an exercise device with forced pronation or supination movement of the hand and arms in conjunction with the standard range of motion for a specified exercise. The device comprises a conventional frame and a centrally mounted seat. The seat is bisected by a vertical midplane that extends through the middle of the frame. The device has two sides that are mirror images with respect to the vertical midplane.

Pivotally attached to the frame is a sub-frame including a pair of levers. A "U" shaped member attached between the levers provides structural support and requires the levers to pivot in tandem about a first axis of rotation A1.

Movably attached to the distal end of each lever is a double "L" shaped handle. The handle includes an elongated tubular grip section and a shorter cylindrical section attached 90° to the grip. The cylindrical section passes through an opening in the distal end of the lever, thereby allowing pivotal movement of the grip about a second axis of rotation A2.

A second leg of the double "L" shaped handle is attached at a 90° angle to the cylindrical section of the handle. A linkage rod is movably attached by means of a ball and socket connector to the distal end of the leg portion of the handle. The linkage rod is movably attached by means of a second ball and socket connector to the frame.

In operation, as force is applied by the exerciser to the handle, the lever of the sub-frame is pivoted forward about axis A1. As the lever pivots about axis A1, the handle is forced to pivot in a predetermined fixed relationship about axis A2. The hand and forearm of the exerciser undergoes a pronation or supination movement as the grip handle is pivoted about the axis A2 when the levers are pivoted about the axis A1. The hand and forearm also move down and in as the lever is pivoted.

In an alternate embodiment, a pair of miter gears are inserted in place of the linkage rod and ball and socket connectors. A stationary miter gear is located on a fixed axle and adjacent to the previously described lever. A hub is affixed to the proximal end of the lever oriented 90° to the fixed axle. A rolling miter gear is mounted on the hub such that the rolling miter gear is oriented 90° to the stationary miter gear. Attached to the rolling. miter gear is a bracket. As the rolling gear rotates, the bracket pivots about the hub in an axis A4, in a plane perpendicular to the plane of axis A1.

The distal end of the bracket is pivotally connected to the first end of the connector rod, allowing for pivotal movement of the bracket about an axis of rotation A5 that is parallel to, but displaced from, axis A4.

In the second embodiment, the handle includes an elongated tubular grip section and a shorter cylindrical section attached at a 90° angle to the grip section, said cylindrical section passes through an opening in the distal end of the lever allowing for pivotal movement of the grip section about an axis of rotation A6.

Connected to the cylindrical section and perpendicular to the axis of the cylindrical section is a bracket. The distal end of the bracket is pivotally connected to the linkage rod. Pivotal movement of the linkage rod is allowed about axis A7 in a plane parallel to but displaced from the plane of pivotal movement of handle.

During operation of the second embodiment, as force is applied by the exerciser to the handle, the sub-frame is pivoted forward about axis A1. As the lever pivots about axis A1, the stationary gear forces the rolling gear to rotate. The bracket affixed to the rotating gear pivots about axis A4, perpendicular to axis A1, thereby forcing the linkage rod to pivot about axis A5. The linkage rod forces the bracket to rotate about axis A6, thereby pivoting the handle in a predetermined fixed relationship about axis A-6. The hands and forearms of the exerciser undergo a forced pronation or supination movement as the grip handle pivots about the axis A6 when the lever is pivoted about the axis A1.

BRIEF DESCRIPTION OF THE DRAWINGS

A more complete understanding of the present invention may be had by reference to the following Detailed Description when taken in conjunction with the accompanying drawings wherein.

DETAILED DESCRIPTION OF THE INVENTION

Figure 1:
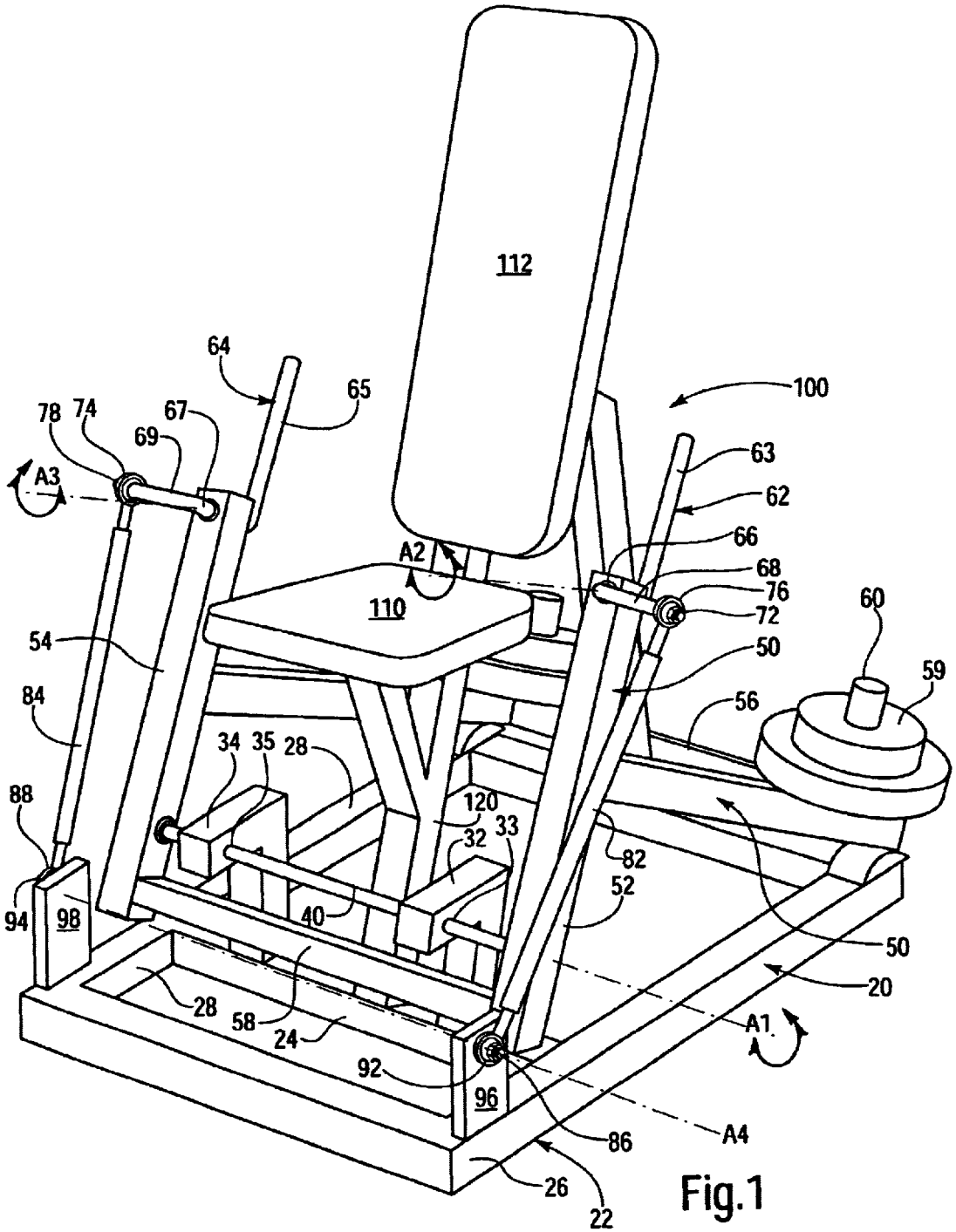
FIG. 1 is a perspective view of an exercise machine comprising the first embodiment of the present invention.

Reference is now made to the Drawings wherein like reference characters denote like or similar parts throughout the 15 FIGURES. Referring to FIG. 1, therein is illustrated an exercise device 100. A seat 110 and a back 112 are bisected by a vertical midplane that extends through the middle of a frame 20. The device 100 has two sides that are mirror images with respect to the vertical midplane.

The device 100 comprises a conventional frame 20 including a rectangular base 22 formed of standard metallic tubing, an intermediate cross brace 24 perpendicularly disposed between an opposing right member 26 and left member 28 of the rectangular base 22. A pair of "L" shaped supports 32 and 34 are rigidly fixed to the top of the cross brace 24. A rod 40 passes through openings 33 and 35 in the "L" shaped supports.

Figure 7:
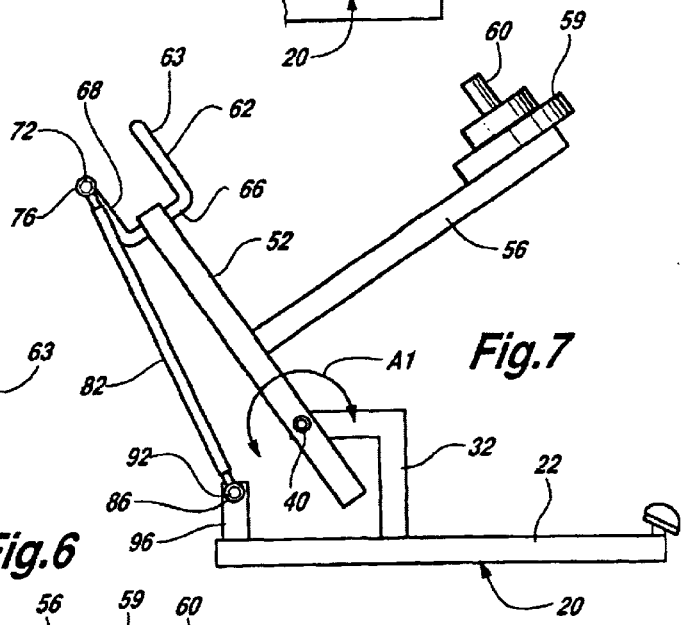
FIG. 7 is a partial side view of the exercise device of FIG. 1, illustrating a second position in the use thereof.
Figure 6:
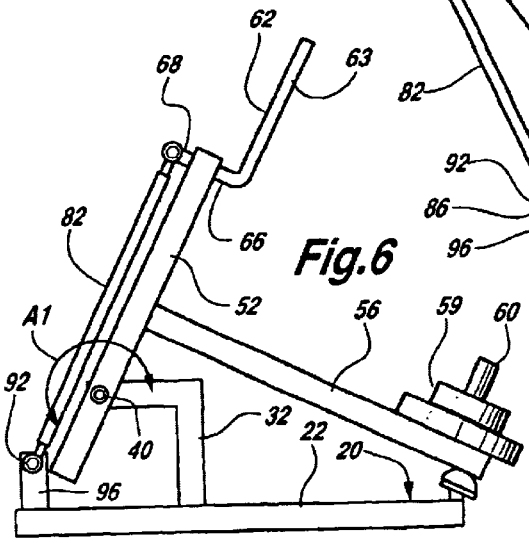
FIG. 6 is a partial side view of the exercise device of FIG. 1, illustrating a first position in the use thereof.

A movable sub-frame 50 includes a right lever 52 and a left lever 54, attached to opposite ends of the rod 40, thereby permitting pivotal movement of the levers 52 and 54 about a horizontal first axis of rotation A1. A "U" shaped member 56 attached between the levers 52 and 53 provides structural stability to the sub-frame 50 and requires the levers 52 and 54 to pivot in tandem about the first axis of rotation A1. A cross brace 58 further reinforces the rigidity and structural stability of the sub-frame 50. A cylindrical post 60 is affixed to the top of the "U" shaped member 56. Standard iron weights 59 may be stacked in increments around the post 60 to provide incremental mass for resisting pivotal movement about axis A1 (see also FIGS. 6 and 7).

Figure 4:
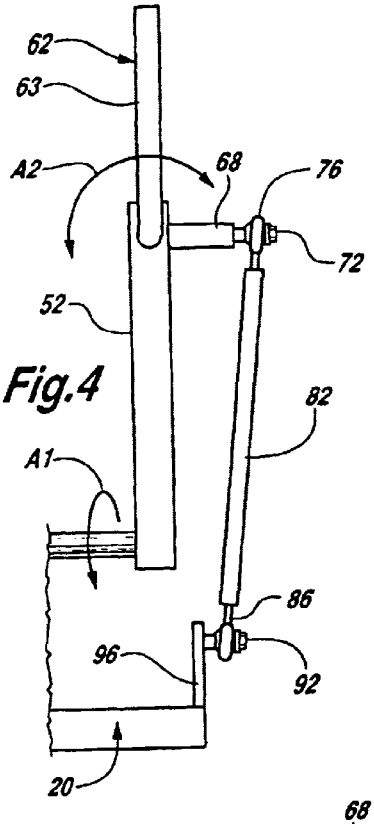
FIG. 4 is a partial rear view of the exercise device of FIG. 1, illustrating a first position in the use thereof.
Figure 5:
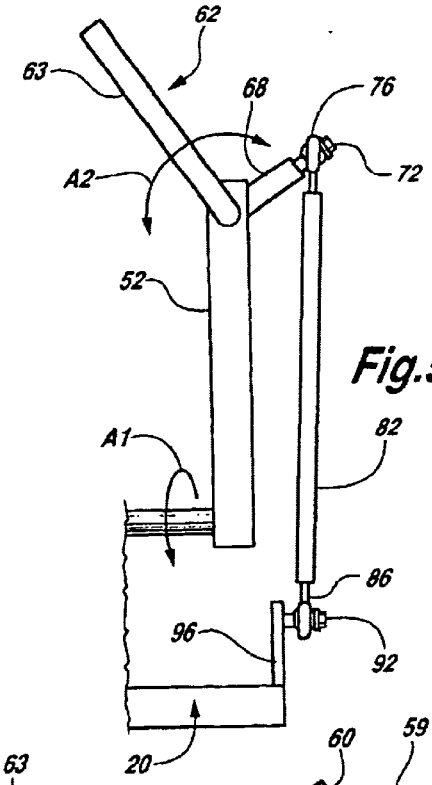
FIG. 5 is a partial rear view of the exercise device of FIG. 1, illustrating a second position in the use thereof.

Referring to FIGS. 4 and 5 in addition to FIG. 1, there is movably attached to the distal end of each lever 52 and 54 identical double "L" shaped handles 62 and 64. Although not shown in FIGS. 4–7, the lever 54 and the handle 64 and their associated components are mirror images of the lever 52 and the handle 62. The handle 62 includes an elongated tubular grip section 63 for grasping by the exerciser's hand. The handle 62 further includes a shorter cylindrical section 66 attached at a 90° angle to the grip section 63 and passing through an opening in the distal end of the lever 52, thereby allowing for pivotal movement of the grip 63 about a second axis of rotation A2. The companion handle 64 includes corresponding elements allowing for pivotal movement of grip 65 about a third axis A3.

The cylindrical section 66 is connected to a second leg 68 of the double "L" shaped handle 62. Similarly, companion double "L" shaped handle 64 includes a second leg 69 attached to cylindrical section 67.

The distal end of the leg 68 of the double "L" shaped handle 62 includes a first ball connector 72. A mating first socket connector 76 is attached to the first end of linkage rod 82. A second socket connector 86 is attached to the opposite end of the linkage rod 82. The socket connector 86 receives a ball connector 92 that is attached to a bracket 96 that is in turn rigidly attached to the base member 22 of the support frame 20. In like manner, the distal end of the leg 69 of the double "L" shaped handle 64 includes a first ball connector 74. A mating first socket connector 78 is attached to the first end of the linkage rod 84. A second socket connector 88 is attached to the opposite end of linkage rod 84. The second socket connector 88 receives a ball connector 94 that is in turn attached to a bracket 98 that is rigidly attached to the base member 28 of the support frame 20. Since the two sides of exercise device 100 are mirror images about a vertical mid-plane, linkage rod 84 is a mirror image of linkage rod 82, both as to configuration and position. Thus, axis A4, through the centers of ball connectors 92 and 94, is parallel to horizontal axis A1. The seat 110 and the back 112 are attached to a support 120 that is in turn rigidly attached to the cross support 24 of the frame 20. The seat 110 and the back 112 are positioned between the grip handles 62 and 64 and the levers 52 and 54.

Figure 3:
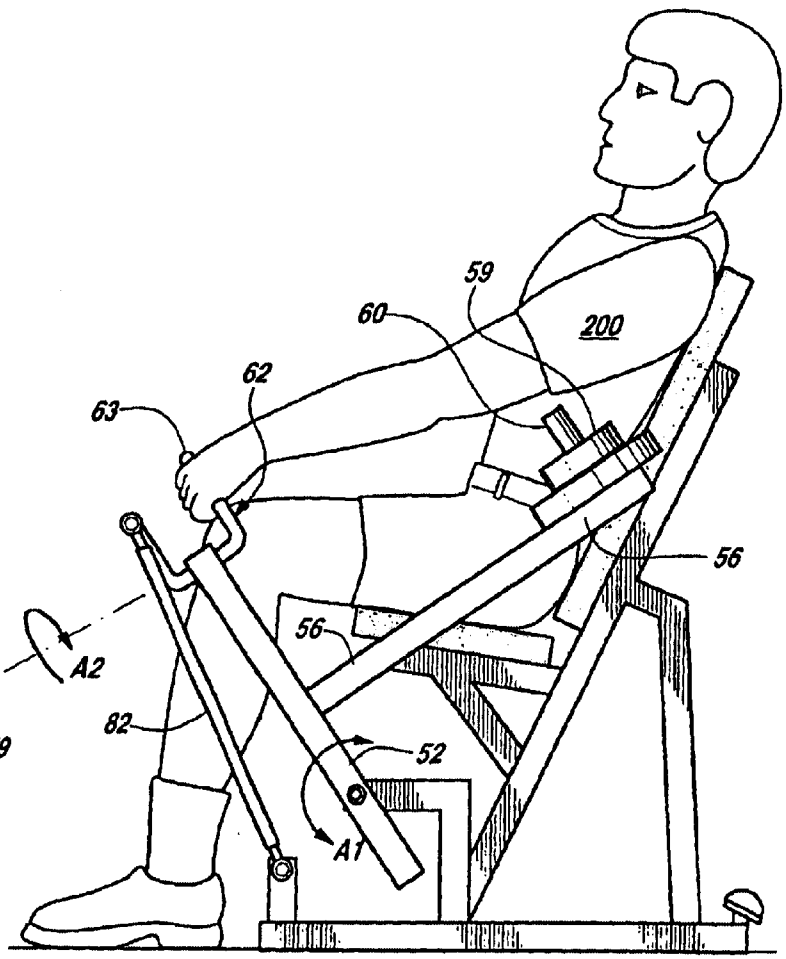
FIG. 3 is a side view of the exercise device of FIG. 1, illustrating a second position in the use thereof.
Figure 2:
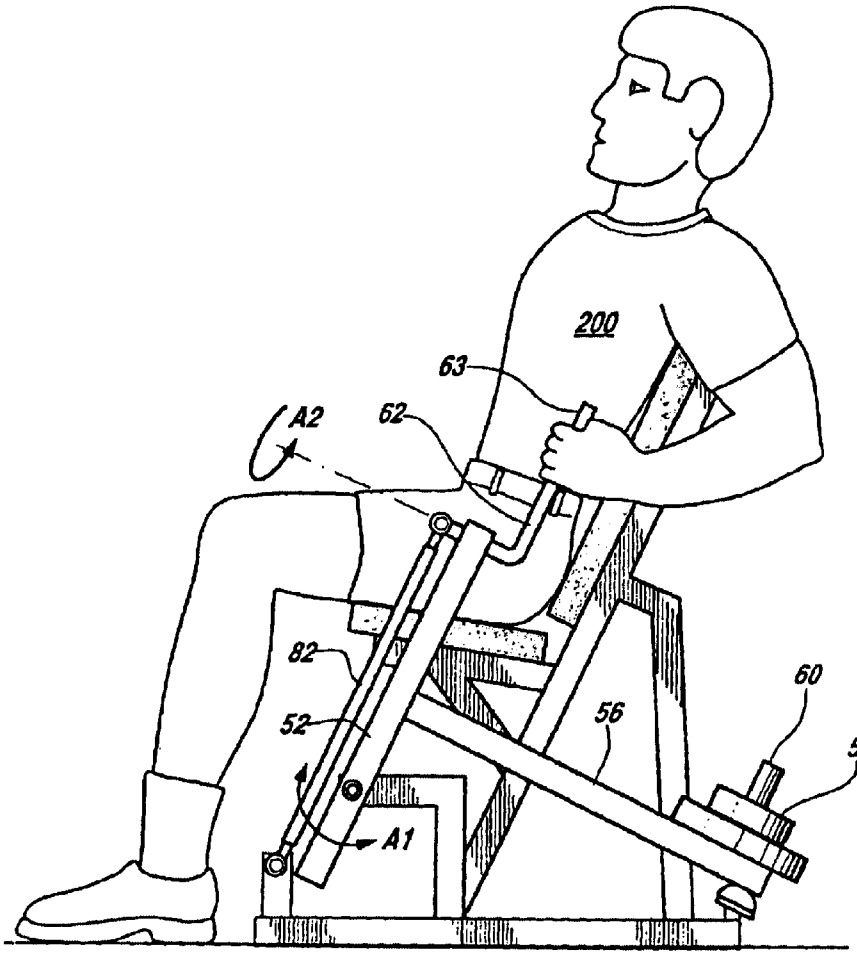
FIG. 2 is a side view of the exercise device of FIG. 1, illustrating a first position in the use thereof.

Referring to FIGS. 2 and 3, in operation, as force is applied by the exerciser 200 to the handle 62 and companion handle 64 (not shown), the lever 52 of the sub-frame 50 is pivoted forward about axis A1. Resistance to forward movement is provided by the mass of the weight stack 59. As is illustrated in FIGS. 3 through 7, as the lever 52 pivots about axis A1, the handle 62 is forced to pivot in a predetermined fixed relationship about axis A-2. The hands and forearms of the exerciser 200 undergo a pronation or supination movement as the grip handles 62 and 64 are pivoted about the axis A2 so as to converge and diverge when the levers are pivoted about the axis A1. The hands and forearms also move down and in as the levers are pivoted.

Referring now to FIGS. 8–11 therein is illustrated an alternate embodiment 180 wherein a pair of miter gears 186 and 188 are inserted in place of the linkage rod 82 and the connectors 72, 74, 76, 78, 86, 88, 92 and 94 of FIGS. 4–7. The below described elements designated by (') reference numerals replace those like numbered elements illustrated in FIGS. 1–3 without the (') designation.

Figure 8:
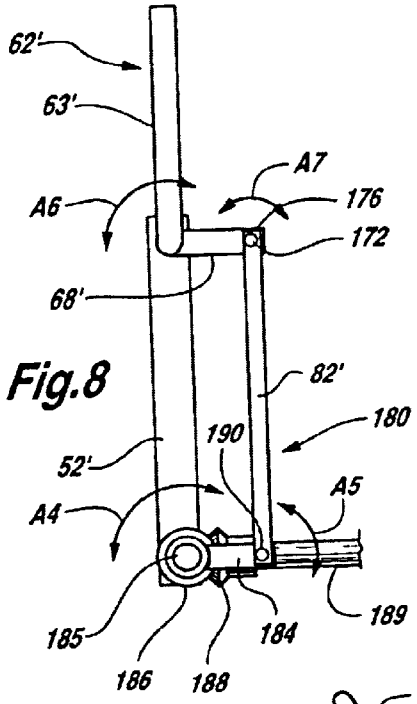
FIG. 8 is a partial rear view of a second embodiment of the exercise device of the present invention, illustrating a first position in the use thereof.
Figure 9:
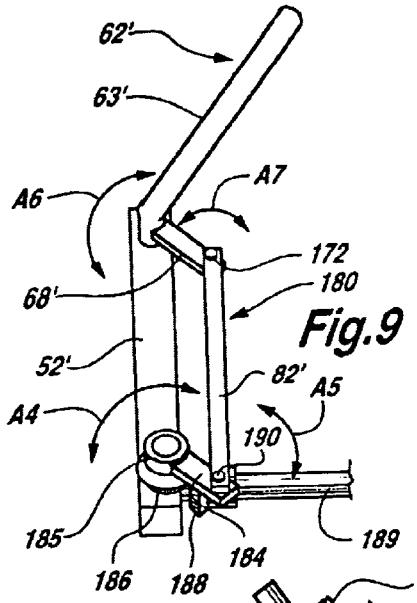
FIG. 9 is a partial rear view of the exercise device of FIG. 8 illustrating a second position in the use thereof.
Figure 11:
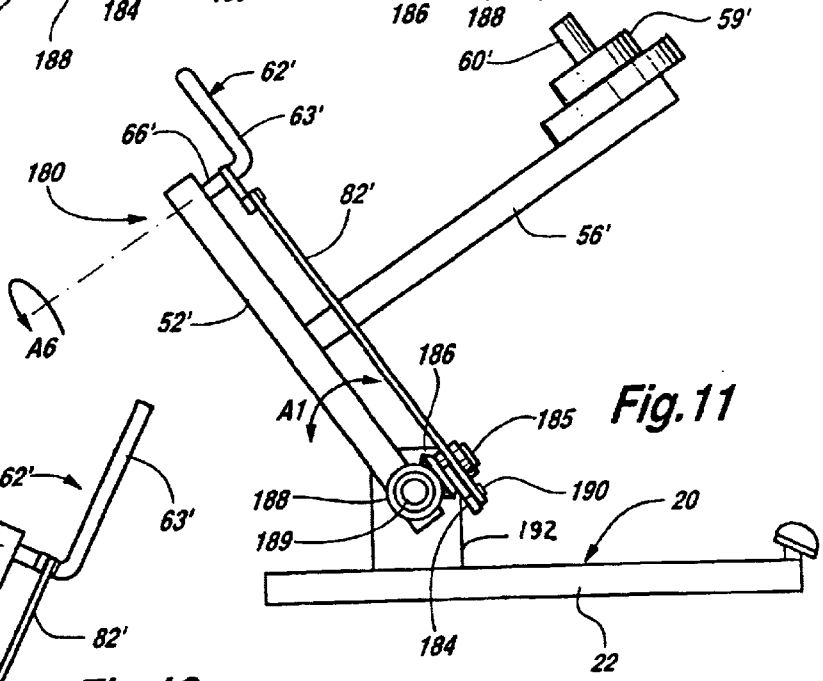
FIG. 11 is a partial side view of the exercise device of FIG. 8 illustrating a second position in the use thereof.
Figure 10:
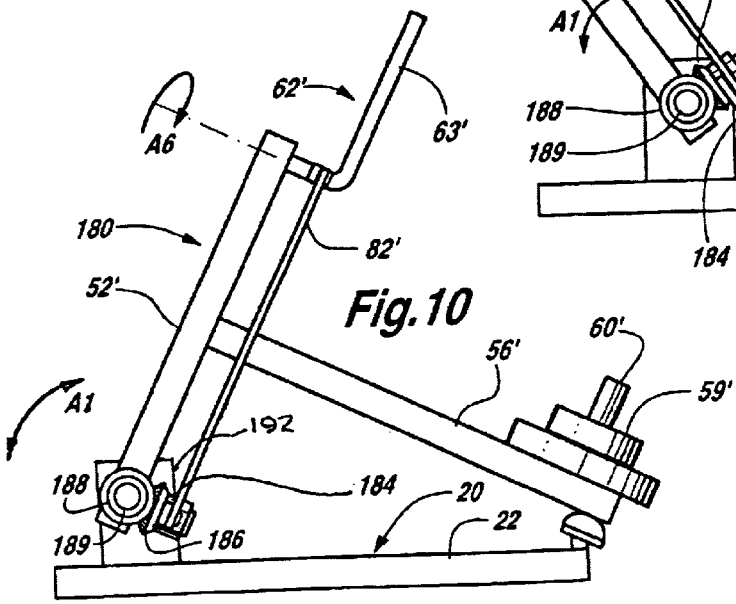
FIG. 10 is a partial side view of the exercise device of FIG. 8 illustrating a first position in the use thereof.

Referring to FIGS. 8 and 9 in addition to FIGS. 1–3, a pair of identical "L" shaped handles 62' and 64' (not shown) are movably attached to the distal ends of a lever 52' and a lever 54' (not shown). Although not shown in FIGS. 8–11, the lever 54' and the handle 64' and their associated components are mirror images of the lever 52' and the handle 62'.

Levers 52' and 54' are mounted at the proximal ends thereof to rotate on fixed axle 189. Fixed axle 189 is rigidly supported by mounting bracket 192. Located on the fixed axle 189 and adjacent to the lever 52' is a stationary miter gear 188 fixed to axle 189. A hub 185 is affixed to the proximal end of the lever 52' oriented 90° to the fixed axle 189. A rolling miter gear 186 is mounted on the hub 185 such that the rolling miter gear 186 is oriented 90° to the stationary miter gear 188. The stationary miter gear 188 and the rolling miter gear 186 include a 45° miter oil their face and are commercially available from the Martin Company of Arlington, Tex. Attached to the rolling miter gear 186 is a bracket 184. As the rolling gear 186 rotates, the bracket 184 pivots about the hub 185 in an axis A4, in a plane perpendicular to the plane of axis A1.

A standard connector pin 190 connects the distal end of the bracket 184 with the first end of the connector rod 82', allowing pivotal movement of the bracket 184 about an axis of rotation A5 that is parallel to, but displaced from axis A4.

The handle 62' includes an elongated tubular grip section 63' for grasping with a hand. The handle 62, further includes a shorter cylindrical section 66' attached at a 90° angle to the grip section 63' and passing through an opening in the distal end of the lever 52' allowing for pivotal movement of the grip section 63' about an axis of rotation A6.

Connected to the cylindrical section 66', and perpendicular to the axis of the cylindrical section 66', is a bracket 68'. The distal end of the bracket 68' includes a standard pin connector 172 received in an opening 176 in linkage rod 82'. Pivotal movement of the linkage rod 82' is allowed about axis A7 in a plane parallel to, but displaced from, the plane of pivotal movement of handle 63'.

During operation of the second embodiment, as force is applied by the exerciser to the handle 62' and the companion handle 64' (not shown), the levers 52' and 54' of the sub-frame 50' are pivoted forward about axis A1. Resistance to forward movement is provided by the mass of the weight stack 59'. As is illustrated in FIGS. 8–11, as the lever 52' pivots about axis A1, the stationary gear 188 rotates rolling gear 186. The bracket 184 affixed to the gear 186 pivots about axis A4, perpendicular to axis A1 thereby forcing the linkage rod 82' to pivot about axis A5. The linkage rod 82' forces the bracket 68' to rotate about axis A6, thereby pivoting the handle 62' in a predetermined fixed relationship about axis A-6. The hands and forearms of the exerciser undergo a forced pronation or supination movement as the grip handle 62' pivots about the axis A6 when the lever 52' is pivoted about the axis A1.

Figures 12, 13, 14:
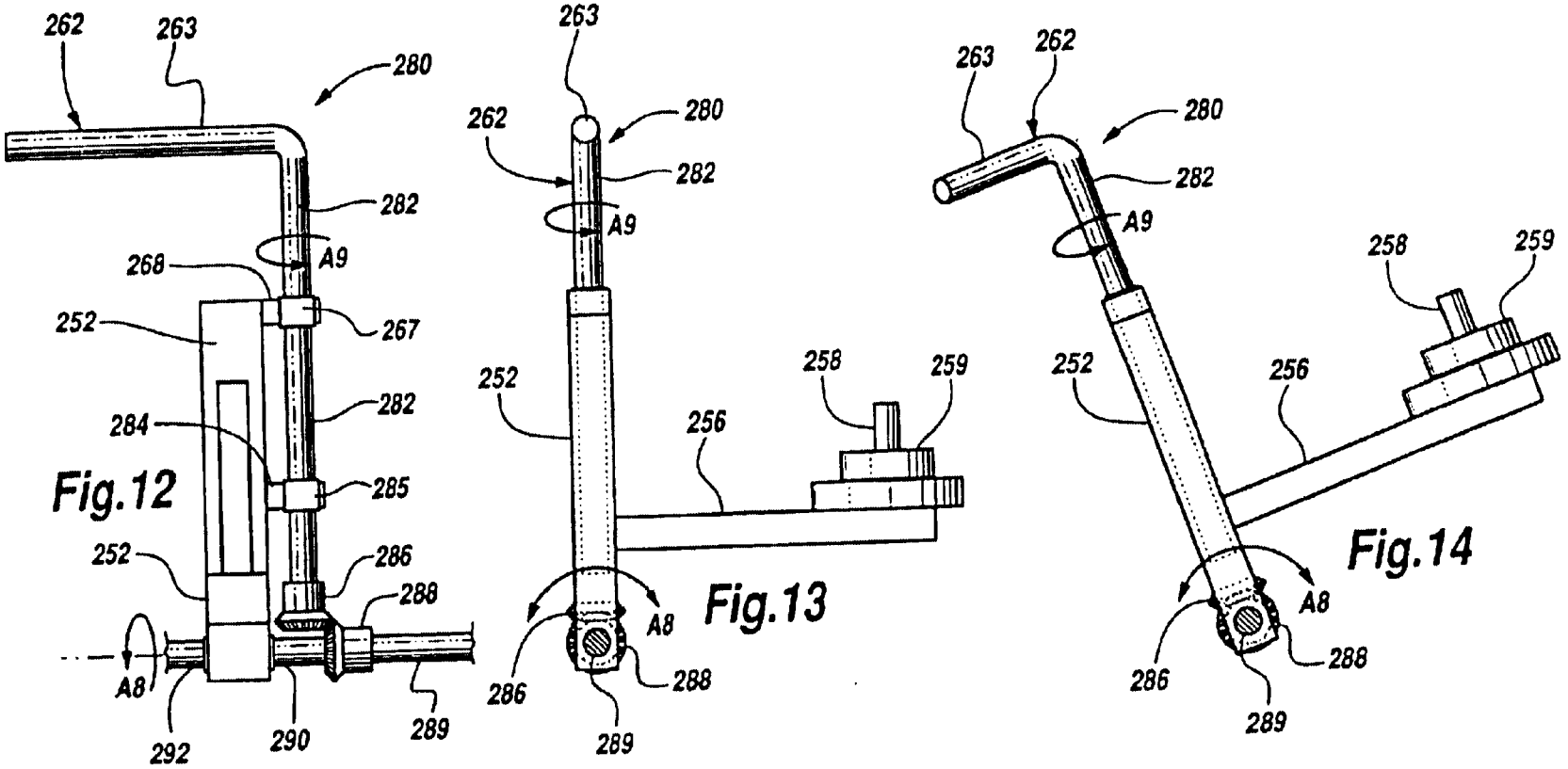
FIG. 12 is a partial front view of a third embodiment of the exercise device of the present invention illustrating a first position in the use thereof.
FIG. 13 is a partial side view of the exercise device of FIG. 12 illustrating a first position in the use thereof.
FIG. 14 is a partial side view of the exercise device of FIG. 12 illustrating a second position in the use thereof.

Referring now to FIGS. 12–14 therein is illustrated a third embodiment 280 of the present invention that provides for a modified hand and arm motion occurring as the hands and arms moved through the desired exercise range of motion. An "L" shaped handle 262 is movably attached to a lever 252 by means of brackets 268 and 284 and bearings 267 and 285. The handle 262 includes an elongated tubular grip section 263 for grasping with a hand. The handle 262 further includes a leg section 282 attached at a 90° angle to the grip section 263, said leg section 282 is disposed through the bearings 267 and 285 of brackets 268 and 284 providing for pivoting movement of the grip section 263 about an axis of rotation A9.

On the proximal end of the lever 252 is a cylindrical opening containing a pair of bearings 290 and 292. The lever 252 is pivotally mounted on a fixed axle 289 that passes through the bearings 290 and 292, thereby providing for a pivoting movement about an axis A8.

A rolling miter gear 286 is fixably mounted on the leg section 282 of the handle 262. Located on the fixed axle 289 and adjacent to the lever 252 is a stationary miter gear 288. The rolling miter gear 286 is oriented 90° to the stationary miter gear 288. The stationary miter gear 288 and the rolling miter gear 286 include 20° pressure angle gear teeth with a 45° bevel angle and are commercially available from the Martin Company of Arlington, Tex. Cylindrical post 258 is affixed to the top of member 256, which extends from lever 252. Standard iron weights may be stacked in increments around post 258 to provide incremental mass for resisting pivotal movement about axis A8.

During operation of the, third embodiment, as force is applied by the exerciser 200 to the handle 262, the lever 252 is pivoted forward about axis A8. Resistance to forward movement is provided by the mass of the weight stack 259. As is illustrated in FIGS. 12–14, as the lever 252 pivots about axis AB, the stationary gear 288 forces rolling gear 286 to rotate about axis A9. The leg section 282 affixed to rolling gear 286 rotates with gear 286 thereby pivoting the grip handle 263 in a predetermined fixed relationship about the axis A9, perpendicular to axis A8. The hands and arms of the exerciser 200 undergo a forced movement as the grip handle 262 pivots about the axis A9 when tie lever 252 is pivoted about the axis A8.

It is to be understood that the elements of the above-described invention used to create a forced pronation or supination movement may be used in any number of configurations for exercise machines including but not limited to push or pull motions in bench press machines, rowing machines, pull down machines and decline press machines. Although the preferred and alternative embodiments of the invention have been illustrated in the accompanying Drawings and described in the foregoing Detailed Description, it will be understood that the invention is not limited to the embodiment disclosed but is capable of numerous modifications without departing from the scope of the invention as claimed.

Figure 15:
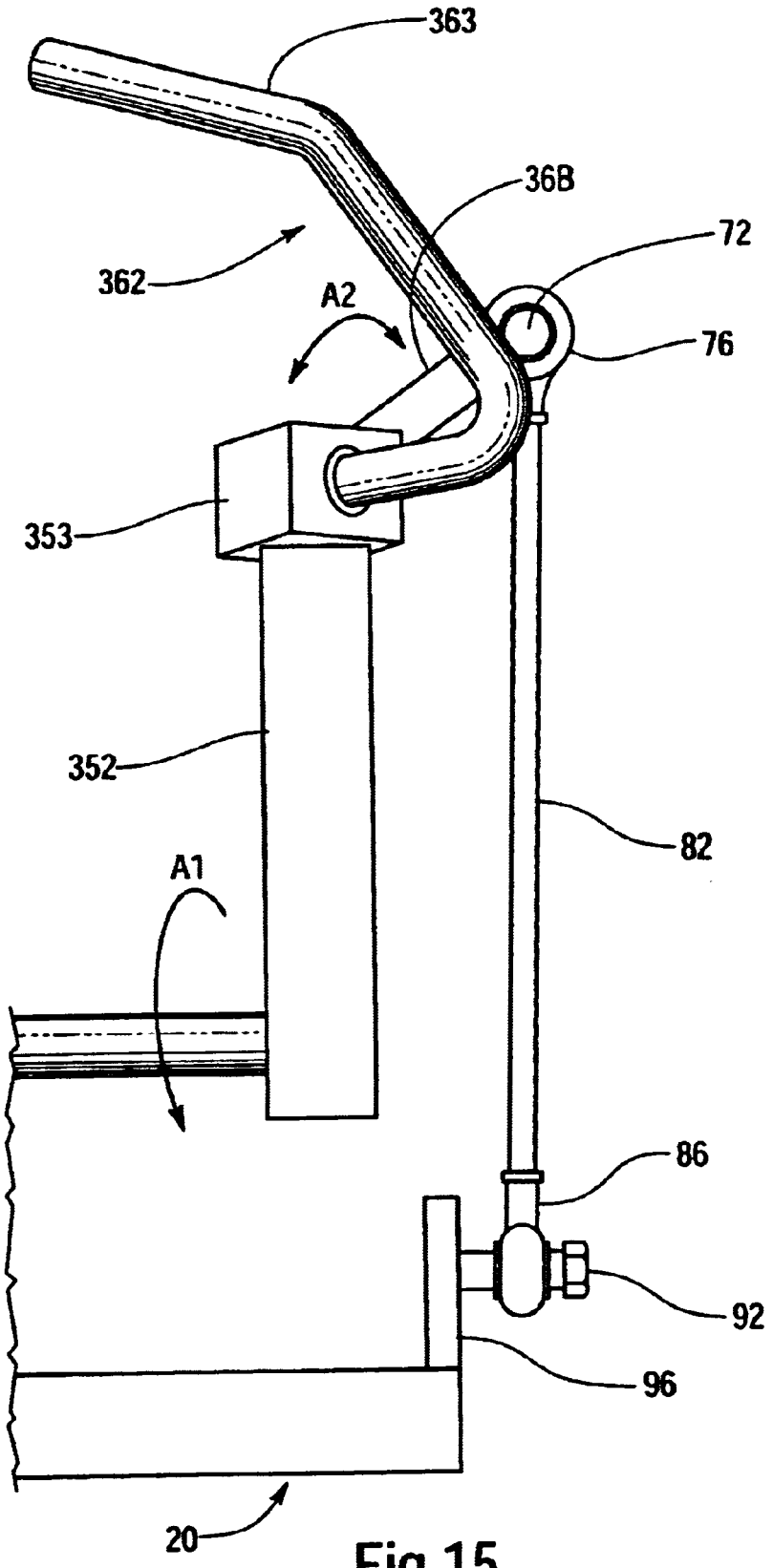
FIG. 15 is a partial auxiliary view, showing an exercise machine similar to FIG. 4 with an alternative handle arrangement.

FIG. 15 shows a partial auxiliary view, showing one side of a symmetrical exercise machine, similar to FIG. 4 , but having an alternative handle arrangement. The proximal end of lever 352 is mounted to rotate about axis A1 in the same manner as lever 52 of FIG. 4. Handle 362 is mounted in skewed end member 353 at the distal end of lever 352 so that handle 362 rotates about axis A2 as lever 352 rotates about axis A1. It is notable that grip portion 363 is bent with respect to the "L" shaped portion of handle 362 so as to be in a position substantially perpendicular to the user's forearm but the shape of handle 362 is otherwise as described for handle 62 of FIG. 4. Skewed member 353 causes axis A2 to be inclined at an angle of as much as 30°–45° with respect to the user's forearm. Thus, the substantially perpendicular relationship of axis A2 to axis A1 shown and described in FIG. 4 can include angles approximately 45° off perpendicular and still be effective for the purposes of the present invention. Leg 368 extends from handle 362 and connects to linkage rod 82 by means of ball connector 72 and socket connector 76. The opposite end of linkage rod 82 is connected to bracket 96 and frame 20 by socket and ball connectors 86 and 92. This connection causes handle 362 to pivot on axis A2 as lever 352 rotates about axis A1.

I claim:

1. An exercise machine having a variable resistance provided therein, the machine comprising:

a frame;

a seat mounted on the frame;

a backrest attached to the frame rearwardly of the seat;

a motion translation arrangement pivotally mounted on the frame to pivot about at least one horizontal axis, and defining a pair of spaced, parallel, angularly oriented pivot axes, lying substantially perpendicular to the at least one horizontal axis;

a pair of handles movable against the variable resistance, each of the handles having an end pivotally connected to the motion translation arrangement about one of the pivot axes and an end having a handgrip; and the motion translation arrangement including means to compel each handgrip to converge by pivoting about a respective pivot axis as the motion translation arrangement is pivoted about the at least one horizontal axis, the motion translation arrangement constructed and arranged to provide an exercise motion for an exerciser occupying the seat wherein the handgrips are moved in curved planes from a first location spaced laterally from a vertical plane bisecting the exercise machine to a second location substantially inward from the first location at which second location the handgrips are slightly rotated.

2. An exercise machine comprising:

a frame;

a seat mounted on the frame;

a sub-frame pivotally mounted to the frame to pivot about a first horizontal axis and a second horizontal axis parallel to and displaced from the first horizontal axis, the sub-frame including a pair of spaced, parallel, angularly oriented pivot axes, lying substantially perpendicular to the first and second horizontal axis;

a pair of handles, each having a first end pivotally connected to the sub-frame at one of the angularly oriented pivot axes, and a second end provided with a handgrip; and structure for resisting movement of the handles, wherein movement of the handles and sub-frame against the resisting structure and about the first horizontal axis, between a first location and a second location, will be translated into lateral motion of the handgrips about the angularly oriented pivot axes such that each of the handgrips will move in curved planes from a first location spaced laterally from a vertical plane bisecting the exercise machine to a second location substantially inwardly from the first location.

3. In an exercise machine having a frame, a seat mounted on the frame and a pair of handles pivotally mounted relative to the frame, the improvement comprising:

a sub-frame pivotally mounted on the frame to pivot about a major horizontal axis and a minor horizontal axis located substantially parallel to the major axis, the sub-frame defining a pair of spaced, parallel, angularly oriented pivot axes, lying perpendicular to the major and minor horizontal axes; and a pair of transfer linkages, each linkage being rigidly connected at one end to one of the handles and pivotally connected at the other end to the frame about the minor horizontal axis, wherein movement of the sub-frame and handles about the major and minor horizontal axes, will be translated into lateral motion of the handles about the angularly oriented pivot axes such that each handle moves in a curved path from a first location to a second location.

4. An exercise machine comprising:

a stationary frame;

a seat mounted to the frame;

a pair of handles pivotally connected relative to the frame, each of the handles having a first end and a second end provided with a handgrip; and a sub-frame pivotally mounted on the frame to pivot about a first horizontal axis and defining a pair of spaced, parallel, angularly oriented pivot axes, lying perpendicular to the first horizontal axis about which pivot axes the second ends of the handles are swung inwardly and outwardly relative to the seat, the sub-frame including a pair of laterally extending rigid arms, each having a proximal end connected to a first end of one of the handles and a distal end, the sub-frame further including a pair of transfer links, each having a first end joined in a swivel connection to one of the distal ends of the rigid arms and a second end pivotally attached to the frame about a second horizontal axis substantially parallel to the first horizontal axis, wherein movement of the sub-frame and handles about the first and second horizontal axes, will be translated into lateral motion of the handles about the pivot axes such that each of the handgrips will move in curved planes from a first location to a second location.

5. A machine providing adjustable resistance for arm and shoulder exercise movements comprising:

a frame;

a seat mounted on the frame;

a sub-frame pivotally mounted on the frame to pivot about a first horizontal axis against the adjustable resistance, the sub-frame including a pair of spaced apart and parallel second pivot axes, lying substantially perpendicular to the first horizontal axis;

a handle mounted at its proximal end to the sub-frame at each second axis for pivotal movement thereabout and extending from each second axis so that a handgrip at the handle distal end is positioned on each side of the seat; and means for compelling the handles to pronate or supinate by pivoting about their respective second axis as the sub-frame is pivoted about the first horizontal axis, the sub-frame being constructed and arranged to provide an exercise wherein movement of the sub-frame and handles about the first horizontal axis, between a first location and a second location, will be translated into pronation and supination movements of the handgrips about the respective second pivot axes.

6. An exercise device for producing forced pronation and supination movements in the hands of the user, the device comprising;

a frame including a horizontal first axis;

a sub-frame pivoting about the first axis, the sub-frame including:

a pair of sub-frame levers having first and second ends, the first end being proximate the first axis;

means operatively connected to the sub-frame for resisting pivotal movement of the sub-frame levers about the first axis;

a pair of handles, each located for gripping by the user and connected to one sub-frame lever, at the second end thereof, for pivotal movement about a second axis, the second axes each being proximate a lever second end; and means for pivoting each handle about its second axis in a predetermined relationship relative to the sub-frame lever as the sub-frame levers pivot about the first axis.

7. An exercise machine for providing selectively variable resistance through a range of motion comprising;

a frame including a horizontal first axis;

a seat mounted on said frame;

a pair of rigidly joined first members pivotally mounted to said frame for rotation against the selectively variable resistance about said horizontal first axis, said first members each including one of a pair of spaced apart, substantially parallel second axes oriented substantially perpendicular to said horizontal first axis;

a pair of second members each having a mounting end pivotally connected to one of said first members and a handle for rotation about one of the second axis, the handle having a handgrip at the distal end thereof; and linkage means for causing said second members to pivot about said second axes as said first members are caused to pivot about said first axis so that said handle ends converge along predetermined curved paths as said first members pivot from a first position to a second position thereby providing a pronating movement at the handgrip.

8. A method for forcing a pronation or supination movement of the hand in combination with forearm movement relative to the upper arm in an exercise routine comprising the steps of:

providing a lever having a length that is substantially perpendicular to, and rotates about, a first axis;

gripping the lever about a handgrip, the handgrip having a longitudinal axis substantially perpendicular to the forearm, to rotate the lever about the first axis;

resisting the rotation of the lever about the first axis with a selected resistance;

pivoting the handgrip with respect to the lever about a second axis, the second axis being substantially parallel to the forearm; and rotating the handgrip in a predetermined relationship relative to the lever, so that the gripping hand is caused to pronate as the lever rotates in one direction and supinate as the lever rotates in the opposite direction about the first axis.

9. A method for forcing pronation or supination movement of the hand in combination with forearm movement relative to the upper arm in an exercise routine comprising the steps of:

providing a lever having first and second pivotal axes;

mounting the lever for pivotal movement about the first axis;

providing a hand grip in substantially perpendicular alignment to the forearm, the hand grip being mounted rotatably about the second pivotal axis so as to allow rotation of the hand grip thereabout, the second axis being substantially parallel to the forearm;

connecting the handgrip so that rotation of the lever about the first axis forces rotation of the handgrip about the second axis; and providing a selected resistance to the rotation of the lever about the first axis; and gripping the hand grip to manually rotate the lever against the selected resistance and simultaneously force pronation or supination of the gripping hand.

* * * * *